US007770259B2

(12) United States Patent
Janson et al.

(10) Patent No.: US 7,770,259 B2
(45) Date of Patent: Aug. 10, 2010

(54) SUSPENSION-TYPE STORAGE UNIT

(75) Inventors: Steven L. Janson, Deerfield, WI (US); Steven M. Lehmann, Fort Atkinson, WI (US)

(73) Assignee: Spacesaver Corporation, Fort Atkinson, WI (US)

( * ) Notice: Subject to any disclaimer, the term of this patent is extended or adjusted under 35 U.S.C. 154(b) by 336 days.

(21) Appl. No.: 11/912,780

(22) PCT Filed: May 4, 2005

(86) PCT No.: PCT/US2005/015564

§ 371 (c)(1), (2), (4) Date: Oct. 26, 2007

(87) PCT Pub. No.: WO2006/118574

PCT Pub. Date: Nov. 9, 2006

(65) Prior Publication Data

US 2008/0190876 A1 Aug. 14, 2008

(51) Int. Cl.
*E05D 15/06* (2006.01)

(52) U.S. Cl. ..... 16/87 R; 104/89

(58) Field of Classification Search ..... 16/87 R, 16/91, 106; 104/94, 121; 105/146, 155
See application file for complete search history.

(56) References Cited

U.S. PATENT DOCUMENTS 766,660 A 8/1904 Bohannan
1,392,575 A 10/1921 Gladish

FOREIGN PATENT DOCUMENTS

JP 2005-48554 2/2005

OTHER PUBLICATIONS

"Moving Painting Storage System", Crystallizations Systems, Inc., www.csistorage.com/painting.html.

*Primary Examiner*—S. Joseph Morano
*Assistant Examiner*—Zachary Kuhfuss
(74) *Attorney, Agent, or Firm*—Andrus, Sceales, Starke & Sawall, LLP

(57) ABSTRACT

A suspension-type storage unit that is particularly well suited for storing works of art or other hanging items in a space-efficient manner The storage unit includes a number of features that enable the storage unit to be moved between retracted and extended positions with a smooth, easy motion, without vibration, so as to protect and prevent damage to articles or items carried by the storage unit. The storage unit includes an overhead rail that defines a downwardly open guide slot and a pair of support surfaces located one on each side of the guide slot, in combination with a frame and at least a pair of trolley assemblies interposed between the rail and the frame for enabling movement of the frame relative to the rail along the guide slot. Each trolley assembly is formed with a head section that extends through the guide slot, and a wheel arrangement that is mounted to the head section. The wheel arrangement includes a pair of wheels between which the head section is located. Each wheel is engaged with one of the support surfaces of the overhead rail, for providing movement of the trolley along the rail. Each trolley assembly further includes a pair of arms that extend in opposite directions from the head section, and the frame is engaged with the pair of arms in a suspension-type manner.

(Continued)

20 Claims, 11 Drawing Sheets

U.S. PATENT DOCUMENTS 1,688,255 A 7/1927 Wasch
1,670,880 A 5/1928 Davis
1,772,314 A 8/1930 Hormes
1,807,075 A 5/1931 Skar et al.
2,553,459 A 5/1951 Klein
2,866,663 A 12/1958 Ashford
3,070,828 A 1/1963 Clinton et al.
3,193,870 A 7/1965 McNinch
3,570,683 A 3/1971 Dickgiesser et al.
3,900,108 A 8/1975 Rottermann et al.
3,951,076 A 4/1976 Knudsen et al.
4,023,236 A * 5/1977 Azuma ..... 16/97
4,084,125 A 4/1978 King
4,122,778 A 10/1978 Di Rosa
4,123,126 A 10/1978 Querengasser
4,144,972 A 3/1979 Wiser
4,172,423 A 10/1979 Monne
4,178,856 A 12/1979 Dunville
4,201,428 A 5/1980 Johnson
4,267,778 A 5/1981 Wilkie
4,301,623 A 11/1981 Demukai
4,314,512 A 2/1982 Gerhard et al.
4,395,078 A 7/1983 Smith, Sr. et al.
4,592,527 A 6/1986 Karapita
4,615,449 A 10/1986 Naito et al.
4,617,867 A 10/1986 Arneteg
4,621,876 A 11/1986 Reimer
4,642,844 A 2/1987 Johnston
4,657,317 A 4/1987 Gemma
4,752,987 A 6/1988 Dreyer et al.
4,807,765 A 2/1989 Brown et al.
4,818,043 A 4/1989 Borgen
4,837,891 A 6/1989 Toma et al.
4,872,287 A 10/1989 Block
4,940,297 A 7/1990 Borgen
4,941,578 A 7/1990 Devening
4,991,725 A 2/1991 Welsch et al.
4,993,328 A 2/1991 Wendt et al.
5,072,838 A 12/1991 Price, Jr. et al.
5,205,627 A 4/1993 Davison et al.
5,265,739 A 11/1993 Price, Jr. et al.
5,343,594 A * 9/1994 Harvey ..... 16/105
5,680,942 A 10/1997 McAllister et al.
5,683,155 A 11/1997 Sarno
5,720,230 A 2/1998 Mansfield
5,924,779 A 7/1999 Krumholz
5,943,967 A 8/1999 Sherman
5,944,201 A 8/1999 Babboni et al.
6,027,190 A 2/2000 Stewart et al.
6,036,286 A 3/2000 Krumholz
6,231,138 B1 5/2001 Janson
6,269,944 B1 * 8/2001 Taylor ..... 198/860.2
6,393,772 B1 5/2002 McRoberts et al.
6,416,143 B1 7/2002 Janson
6,487,753 B1 12/2002 Lonnberg
6,547,087 B2 4/2003 Accatino
6,561,601 B1 5/2003 Maffeo
6,688,708 B1 2/2004 Janson

* cited by examiner

SUSPENSION-TYPE STORAGE UNIT

BACKGROUND AND SUMMARY OF THE INVENTION

This invention relates to a storage system, and more particularly to a suspension-type storage unit that is adapted for movement on an overhead rail between an extended position and a retracted position.

Suspension-type storage units are well known for use in storing a wide variety of objects, articles, media or the like. Typically, storage units of this type are mounted to one or more overhead rails, and are adapted for movement on the one or more rails between a retracted, storage position and an extended, access position in which the items on or in the storage unit can be accessed by a user.

The present invention contemplates a suspension-type storage unit that is particularly well suited for storing works of art or other hanging items in a space-efficient manner. The storage unit of the present invention includes a number of features that enable the storage unit to be moved between retracted and extended positions with a smooth, easy motion, without vibration, so as to protect and prevent damage to articles or items carried by the storage unit. While the storage unit is well suited to safely store, access, organize and protect framed art and other cultural artifacts, the storage unit may also be used for tools and equipment, evidence, medical instruments and supplies, and a wide range of other objects. The storage unit may be incorporated in a system that includes a number of similarly constructed storage units to provide easy access to objects supported by each storage unit when moved to its extended, access position. The storage system can easily be expanded by adding additional storage units.

In accordance with one aspect of the present invention, a suspension-type storage unit includes an overhead rail that defines a downwardly open guide slot and a pair of support surfaces located one on each side of the guide slot, in combination with a frame and at least a pair of trolley assemblies interposed between the rail and the frame for enabling movement of the frame relative to the rail along the guide slot. The frame is adapted to support the items or objects stored by the storage unit. Representatively, a vertical screen may be mounted to the frame, and the objects or items to be stored are suspended, hung or otherwise secured to the screen.

Each trolley assembly is formed with a head section that extends through the guide slot, and a wheel arrangement that is mounted to the head section. The wheel arrangement includes a pair of wheels between which the head section is located. Each wheel is engaged with one of the support surfaces of the overhead rail, for providing movement of the trolley along the rail. Each trolley assembly further includes a pair of arms that extend outwardly in opposite directions from the head section. The frame is supported from the pair of arms in a suspension-type manner. In one embodiment, the trolley arms are contained within a recess or channel formed between a pair of flanges that extend upwardly from an upper frame member. The frame is supported from the arms via a frame support member mounted within the channel over each of the arms. Each frame support member includes a mounting member secured to the frame within the channel, and a damper member between each arm and one of the mounting members. A guide member is mounted to each mounting member, and each guide member extends upwardly from the mounting member into the downwardly open guide slot of the overhead rail to maintain the trolley in alignment with the rail during movement of the trolley along the rail. The pair of arms and each overlying mounting member are formed of a metallic material, and the damper member between each arm and its overlying mounting members is formed of a non-metallic resilient material, to provide a cushioned suspension arrangement for the frame.

This aspect of the invention also contemplates a method of securing a storage member of a storage unit in a suspension-type manner to a trolley, substantially in accordance with the foregoing summary.

In accordance with another aspect of the invention, a suspension-type storage unit includes an overhead rail spaced above an upwardly facing surface, a frame defining an upper area and a lower area, a movable suspension-type connection between the rail and the upper area of the frame for providing movement of the frame along the rail, and a guide wheel carried by the lower area of the frame. The frame is configured and arranged such that the guide wheel is engaged with the upwardly facing surface to guide movement of the frame relative to the support surface as the frame is moved along the rail, without the use of a guide rail mounted to the storage unit. A biasing arrangement is interconnected with the guide wheel for biasing the guide wheel into engagement with the upwardly facing surface. In one form, the guide wheel is mounted to the lower end of a shaft, and the shaft is mounted in aligned openings in a mounting bracket secured to the frame. The biasing arrangement may be in the form of a spring that acts on the shaft and on the mounting bracket to bias the shaft, and thereby the guide wheel, downwardly into engagement with the upwardly facing surface. This aspect of the invention also contemplates a method of guiding movement of a suspension-type storage unit relative to an upwardly facing surface, substantially in accordance with the foregoing summary.

In accordance with yet another aspect of the invention, a suspension-type storage unit includes an overhead rail spaced above an upwardly facing surface, a frame defining an upper area and a lower area, a movable suspension-type connection between the rail and the upper area of the frame for providing movement of the frame along the rail for providing movement of the frame between first and second positions relative to the support surface, and a deceleration arrangement interposed between the lower area of the frame and the upwardly facing surface to slow movement of the frame as the frame approaches at least one of the first and second positions relative to the support surface. The deceleration arrangement includes a magnetic member and a magnetically attractive member, which are arranged such that magnetic forces between the magnetic member and the magnetically attractive member cooperate to slow movement of the frame as the frame approaches at least one of the first and second positions. One of the magnetic member and the magnetically attractive member is stationarily mounted to the upwardly facing surface, and the other of the magnetic member and the magnetically attractive member is mounted to the frame for movement along with the frame. With this arrangement, the magnetic member and the magnetically attractive member come into overlapping relationship as the frame approaches a predetermined position relative to the upwardly facing surface, and the magnetic force between the magnetic member and the magnetically attractive member slows movement of the frame. This aspect of the invention also contemplates a method of slowing movement of a storage unit that is movable between first and second positions relative to a surface, substantially in accordance with the foregoing summary.

The various features and aspects of the present invention may be employed separately, and each enhances operation of a movable storage unit. The features and aspects of the present invention may also be employed in various subcombinations, to provide desired enhancements in storage unit operation. When the features and aspects of the present invention are employed together, the result is a movable storage unit that provides significantly improved operation over prior art storage units, and which is particularly well suited to store items and objects in a manner that enables easy access and which prevents to stored items and objects from experiencing bumps or jars during movement of the storage unit between the storage and access positions.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
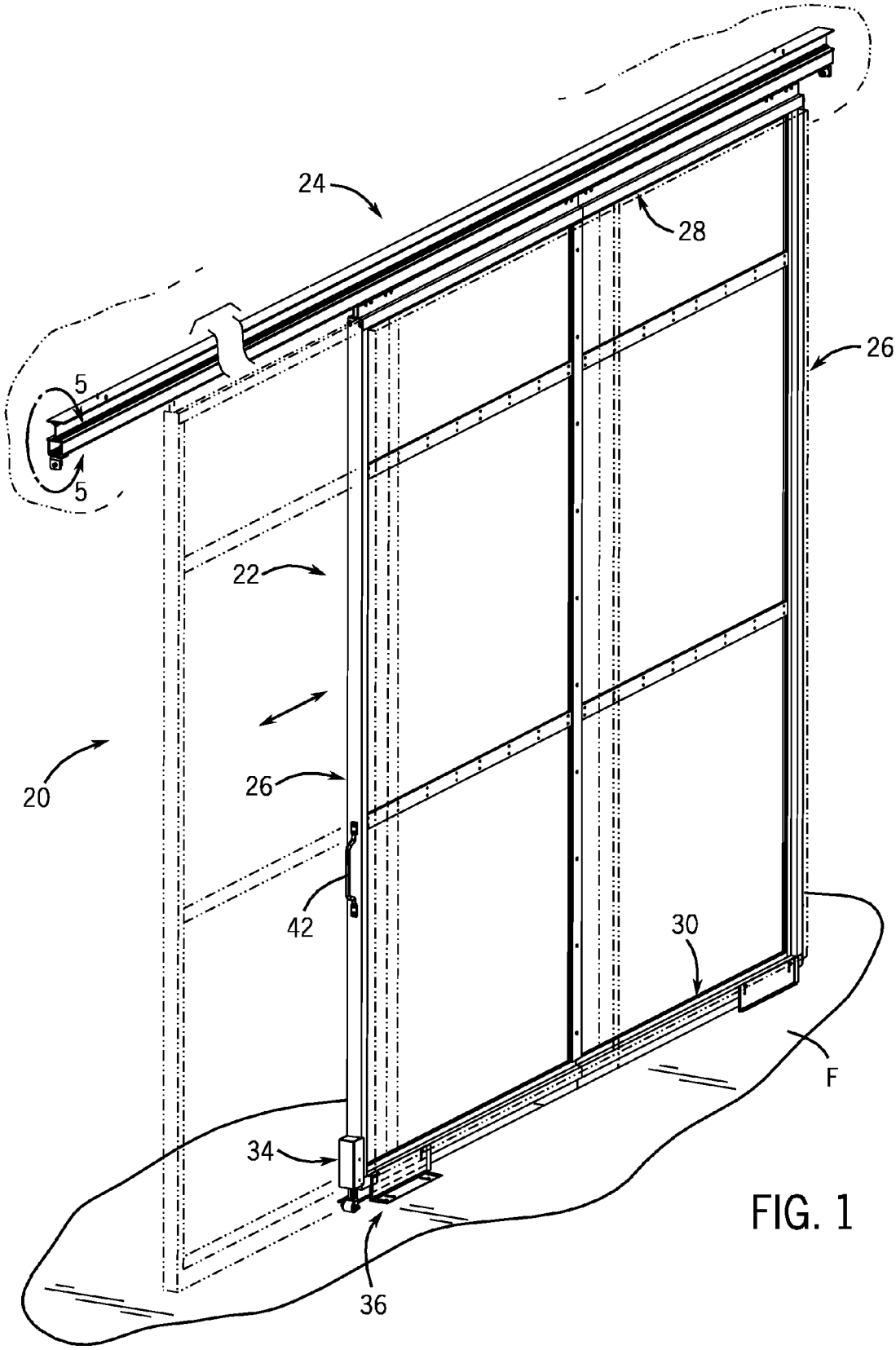
FIG. 1 is an isometric view of a pull-out, suspension-type storage unit in accordance with the present invention.
Figure 3:
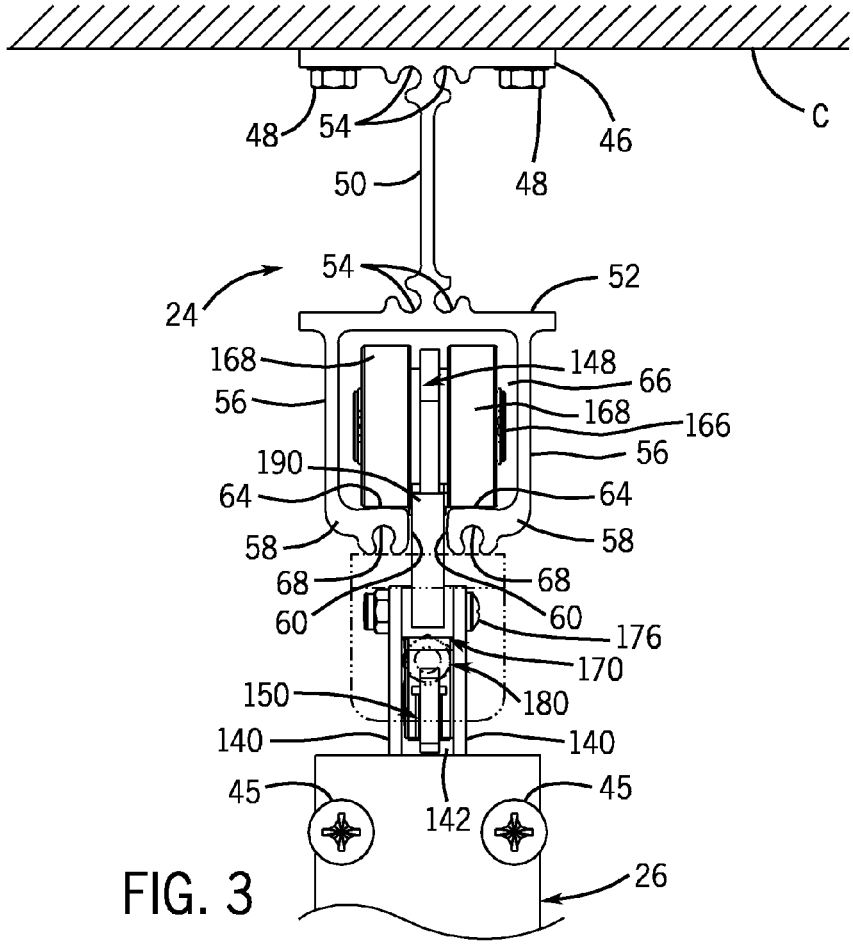
FIG. 3 is an enlarged end elevation view showing the upper components of the storage unit of FIG. 1.
Figure 4:
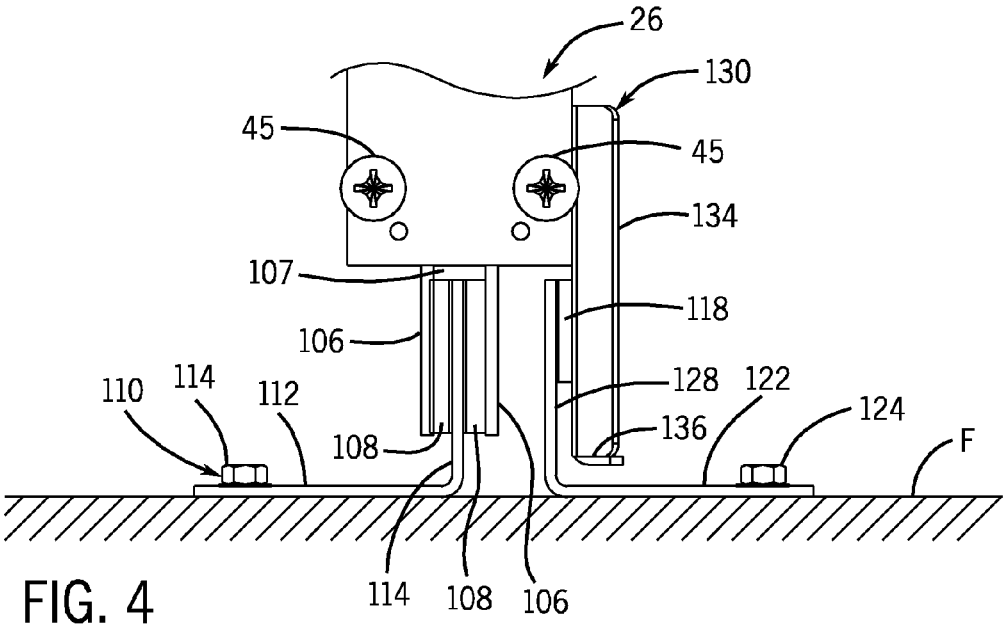
FIG. 4 is an enlarged end elevation view showing the lower components of the storage unit of FIG. 1.

A pull-out, suspension-type storage unit 20 in accordance with the present invention generally includes a frame assembly 22 movably mounted to an overhead rail 24. Frame assembly 22 can be moved on overhead rail 24 between a retracted position, as shown in solid lines in FIG. 1, and an extended position in which frame assembly 22 is moved outwardly on rail 24. The phantom lines in FIG. 1 show frame assembly 22 moved away from the retracted position toward the extended position. Storage unit 20 is adapted to be mounted between a pair of vertically spaced apart surfaces, and is well suited for storing articles in a vertical orientation in which the stored articles are hung or otherwise suspended or engaged with frame assembly 22. Representatively, as shown in FIGS. 1, 3 and 4, storage unit 20 may be positioned within a room having an upwardly facing support surface, such as a floor F, and a downwardly facing surface, such as a ceiling C. It is understood, however, that storage unit 20 may be located between any other vertically spaced support surfaces, and is not limited to installation between the floor and ceiling of a room. Typically, storage unit 20 is one of a number of similarly constructed storage units that are installed in a row, to form a storage system for storing a large number of objects within a building storage area. In a typical application, the series of storage units 20 may be configured to support art works or other objects that are adapted to be hung or otherwise supported in a vertical fashion.

Figure 2:
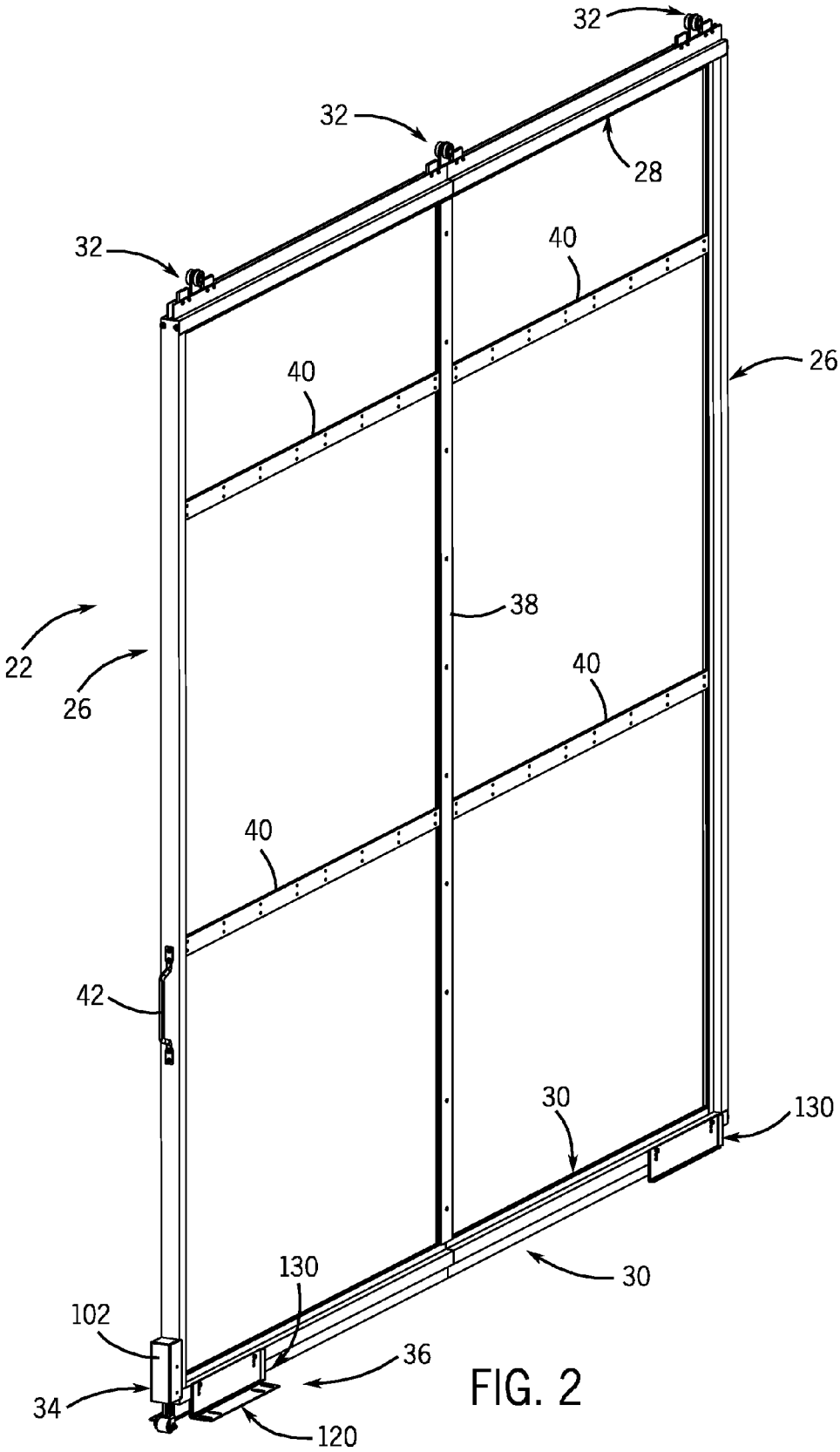
FIG. 2 is an isometric view of a frame assembly incorporated in the storage unit of FIG. 1.

Referring to FIG. 2, frame assembly 22 includes a pair of similarly constructed vertical frame members 26, which extend between and interconnect an upper frame member 28 and a lower frame member 30. Representatively, frame members 26-30 may be formed of a lightweight metallic material such as aluminum in an extrusion process, although it is understood that any other satisfactory material and forming method may be employed. A series of trolley assemblies 32 are mounted to upper frame member 28, and are engaged with overhead rail 24 for providing sliding movement of frame assembly 22 along rail 24, in a manner to be explained. A guide wheel assembly 34 is mounted at the lower end of at least one of vertical frame members 26 for engagement with floor F to guide movement of frame assembly 22 as frame assembly 22 is moved along rail 24. A brake or decelerator 36 is positioned between floor F and lower frame member 30, for providing smooth stopping of frame assembly 22 as frame assembly 22 approaches the extended and retracted positions, in a manner to be explained.

Frame assembly 22 includes an intermediate vertical frame member 38 located between vertical side frame members 26, which is connected at its upper end to upper frame member 28 and at its lower end to lower frame member 30. Cross members 40 extend between intermediate vertical frame member 38 and vertical side frame members 26. A perforated mesh screen (not shown) may be mounted to each side of frame assembly 22, and is supported at its outer periphery by vertical side frame members 26, upper frame member 28 and lower frame member 30, and at its interior by intermediate vertical frame member 38 and cross frame members 40. Alternatively, a planar tack board or any other satisfactory mounting structure may be carried by frame assembly 22 for use in securing objects or articles to the outwardly facing areas of frame assembly 22. A handle 42 is secured to one of vertical side frame members 26, and is adapted for manual engagement by a user so as to move frame assembly 22 along overhead rail 24. If desired, a handle 42 may also be mounted to the other of vertical side frame members 26, for enabling a user to move frame assembly 22 in the both directions.

Figure 13:
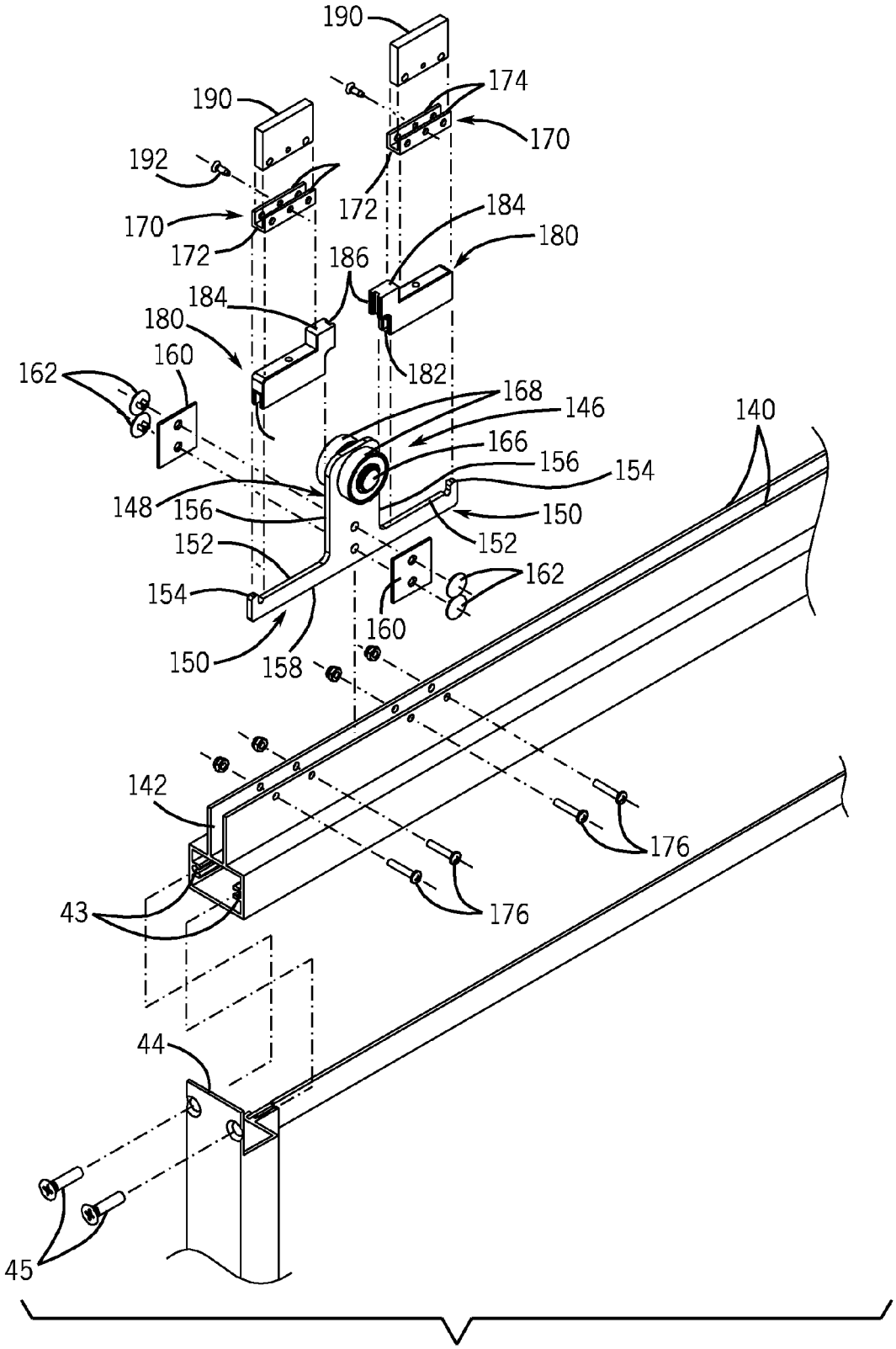
FIG. 13 is an exploded isometric view showing the upper area of the storage unit frame and the trolley assembly of FIGS. 11 and 12.

FIG. 13 illustrates the manner in which vertical frame members 26 are connected to upper frame member 28 and lower frame member 30. Upper and lower frame members 28, 30, respectively, define an interior that includes connection passages 43, and the adjacent end of each vertical frame member 26 includes an extension wall 44 that overlies the end of the interior or each frame member 28, 30. A pair of openings are formed in extension wall 44 in alignment with connection passages 43. Threaded fasteners 45 extend through the extension wall openings and into connection passages 43, to connect the adjacent frame member ends together.

Figure 5:
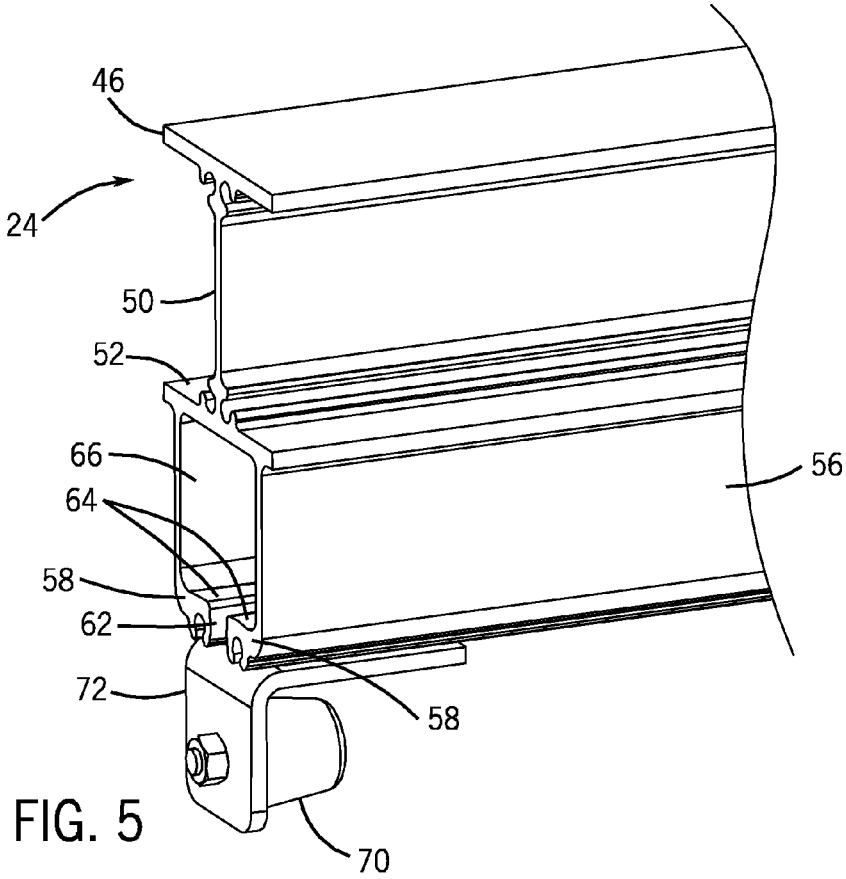
FIG. 5 is an enlarged partial isometric view showing the end area of an overhead rail incorporated in the storage unit of FIG. 1.

FIGS. 3 and 5 illustrate the construction of overhead rail 24, which is particularly well suited to reduce noise and vibration in operation of storage unit 20. Rail 24 includes an I-shaped upper section for mounting to ceiling C, in combination with a box-shaped lower section that supports trolley assemblies 32. The upper area of rail 24 includes an upper flange 46 that is adapted to be engaged with and secured to the downwardly facing surface of ceiling C, such as by the use of anchor bolts 48 that extend into engagement with ceiling-mounted anchors, or in any other satisfactory manner. The upper area of rail 24 further includes a vertical web 50, which extends between upper flange 48 and a lower flange 52. Splice channels or grooves 54 are located at the intersection between upper flange 46 and the upper end of web 50, and at the intersection between lower flange 52 and the lower end of web 50.

A pair of vertical side walls 56 extend downwardly from the lower surface of lower flange 52. A bottom wall 58 extends inwardly from the lower end of each side wall 56. Bottom walls 58 terminate in facing inner surfaces 60, which are spaced apart from each other so as to define a downwardly facing guide slot 62 (FIG. 5) therebetween. The upwardly facing surface of each bottom wall 58 defines a crown 64, which presents a convex upwardly facing surface adjacent guide slot 62. Side walls 56 and bottom walls 58 cooperate to define an internal passage 66 that is coextensive with guide slot 62. Each bottom wall 58 includes a downwardly facing circular splice passage or groove 68.

Representatively, rail 24 may be formed of a metallic material such as aluminum in an extrusion process, although it is understood that any other satisfactory material and forming method may be employed.

As shown in FIG. 5, a bumper 70 is mounted at each end of rail 24 via a bumper mounting bracket 72 that is secured to rail bottom walls 58 in any satisfactory manner. Each bumper 70 is formed of a resilient material such as rubber, and provides an end stop to limit movement of frame assembly 22 relative to rail 24.

Figure 14:
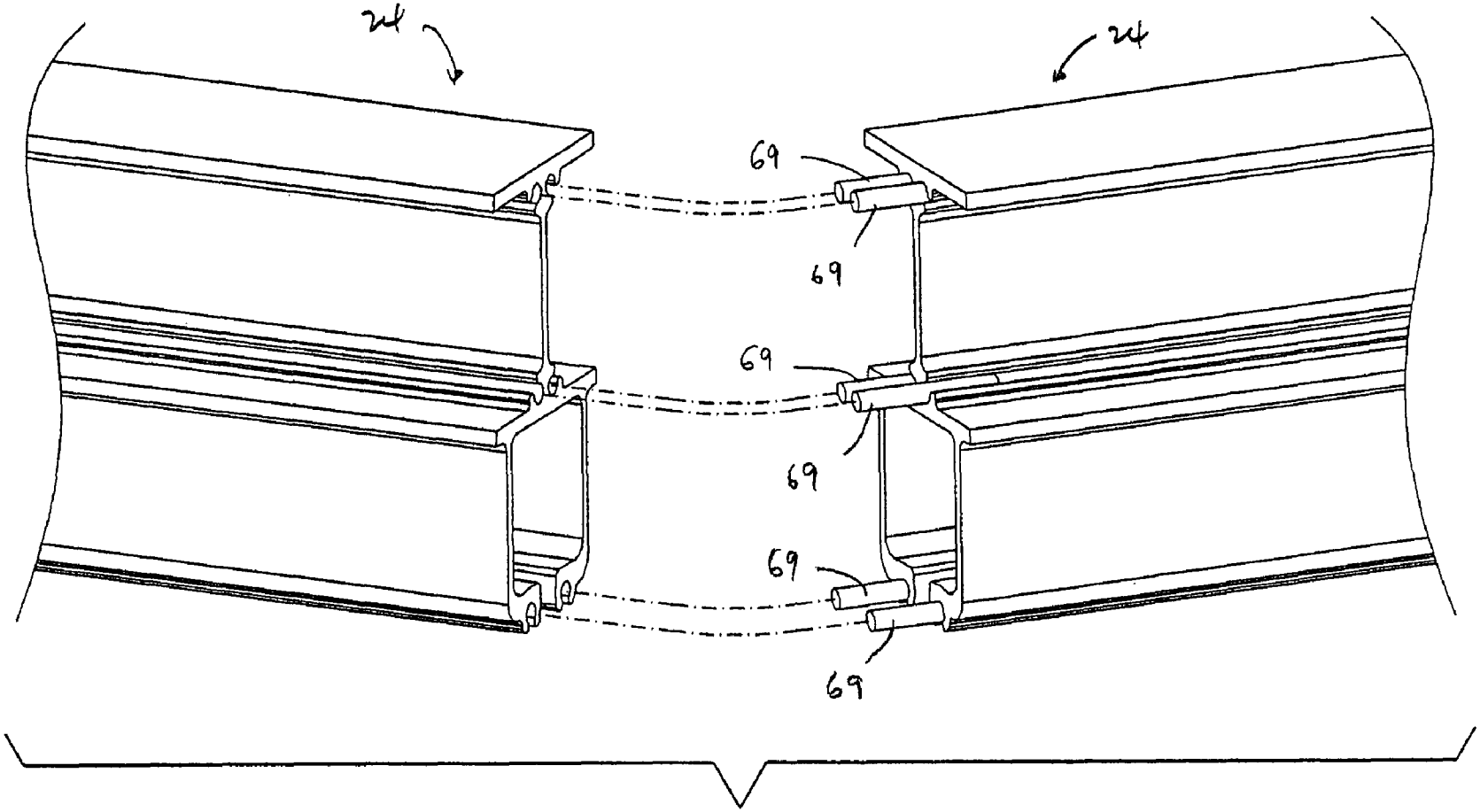
FIG. 14 is a partial isometric view illustrating a splice arrangement for connecting adjacent ends of rail sections incorporated in the storage unit of FIG. 1.

Rail 24 may have any desired length, and is constructed of a series of aligned rail sections that are placed in an end-to-end manner and spliced together. As shown in FIG. 14, a splice pin 69 is engaged within each splice groove 54 and within each splice groove 68. Each splice pin 69 has a cross section that matches the cross section of the splice groove within which the splice pin 69 is received, and is sized so as to fit tightly within the splice groove. The splice pins 69 extend outwardly from the splice grooves of one section of rail 24 into engagement with the splice grooves of the adjacent section of rail 24, and the rail sections are positioned such that the facing ends of the rail sections are in engagement with each other. The splice pins 69 mounted within the splice grooves 54 and 68 provide a rigid joint between the rail sections and ensure proper alignment of the adjacent rail sections.

Referring to FIGS. 6-9, guide wheel assembly 34 is mounted at the lower end of at least an outer one of vertical frame members 26. If desired, a guide wheel assembly 34 may be mounted to each of vertical side frame members 26.

Guide wheel assembly 34 includes a mounting bracket 76 that is secured to the end wall of vertical side frame member 26 in any satisfactory manner, such as by welding. Mounting bracket 76 includes a vertical mounting wall 78, a pair of end walls 80 and a pair of side walls 82. Each end wall 80 includes an opening through which a vertical shaft 84 extends. Shaft 84 has a non-circular cross section, and the aligned openings in end walls 80 are similarly formed. In the illustrated embodiment, shaft 84 has a square cross section, and the aligned openings in end walls 80 are each square in shape so that shaft 84 is received within the aligned openings in a manner that prevents rotation of shaft 84. It is understood that any other satisfactory shape of shaft 84 and openings 80 may be employed, as long as shaft 84 cannot be rotated relative to end walls 80.

A roller mounting bracket 86 is engaged with the lower end of shaft 84. Roller mounting bracket 86 defines a pair of side walls 88 and a top wall 90, to which the lower end of shaft 84 is secured. In the illustrated embodiment, roller mounting bracket 86 has an inverted U-shape, although it is understood that any other satisfactory shape or configuration of roller mounting bracket 86 may be employed.

A guide roller 92 is rotatably mounted to roller mounting bracket 86. Guide roller 92 defines an outer roller surface 94, which is adapted for engagement with floor F. Roller 92 defines a transverse passage, and an axle bolt 96 extends through the roller passage and through aligned openings in side walls 88 of roller mounting bracket 86, to rotatably secure roller 92 between side walls 88. Axle bolt 96, which defines the axis of rotation of roller 92, extends perpendicularly to the longitudinal axis of shaft 84 and to the plane of frame assembly 22.

A cross pin 98 extends through a transverse passage in shaft 84 at a location between mounting bracket end walls 80, and the end areas of cross pin 98 extend outwardly in opposite directions from shaft 84. A spring 100 defines a lower end that engages the end areas of cross pin 98, and an upper end that bears against the downwardly facing surface of upper end wall 80. With this construction, spring 100 functions to bias shaft 84 downwardly, which urges outer surface 94 of roller 92 into engagement with floor F. Roller 92 is preferably formed so that its outer surface 94 is formed of a resilient, high friction material such as urethane, to provide high friction engagement of roller outer surface 94 with floor F.

As shown in FIGS. 1 and 2, a cover 102 is engaged with side walls 82 of mounting bracket 76. Cover 102 is configured so as to enclose spring 100 and the portion of shaft 84 located between end walls 80.

Referring to FIG. 4, lower frame member 30 of frame assembly 22 includes a pair of axially extending flanges 106 that define a channel 107 therebetween. A glide member 108 is mounted to the inner surface of each flange 106. Glide members 108 may be in the form of strips or bars of low friction material, such as a synthetic felt material. A guide member 110 is mounted to floor F, and includes a lower horizontal wall 112 secured to floor F by a series of anchor bolts 114 that extend into anchors in floor F. Guide member 110 further includes an upstanding vertical guide wall 114 located between glide members 108. The laterally facing surfaces of guide wall 114 are located in close tolerance to the facing inner walls of glide members 108. With this arrangement, vertical guide wall 114 of guide member 110 functions to track the lower end of frame assembly 22 as frame assembly 22 is moved on overhead rail 24. Guide member 110 is positioned so as to remain between flanges 106 throughout the entire range of movement of frame assembly 22 between its extended and retracted positions.

Figure 8:
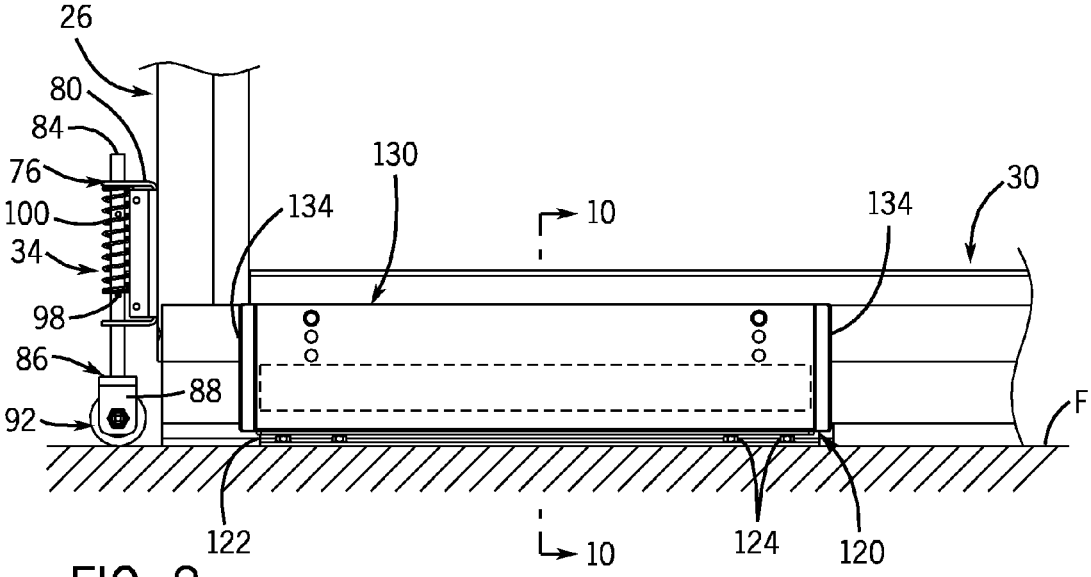
FIG. 8 is a partial side elevation view showing the guide wheel assembly and the brake or decelerator shown in FIG. 7.
Figure 6:
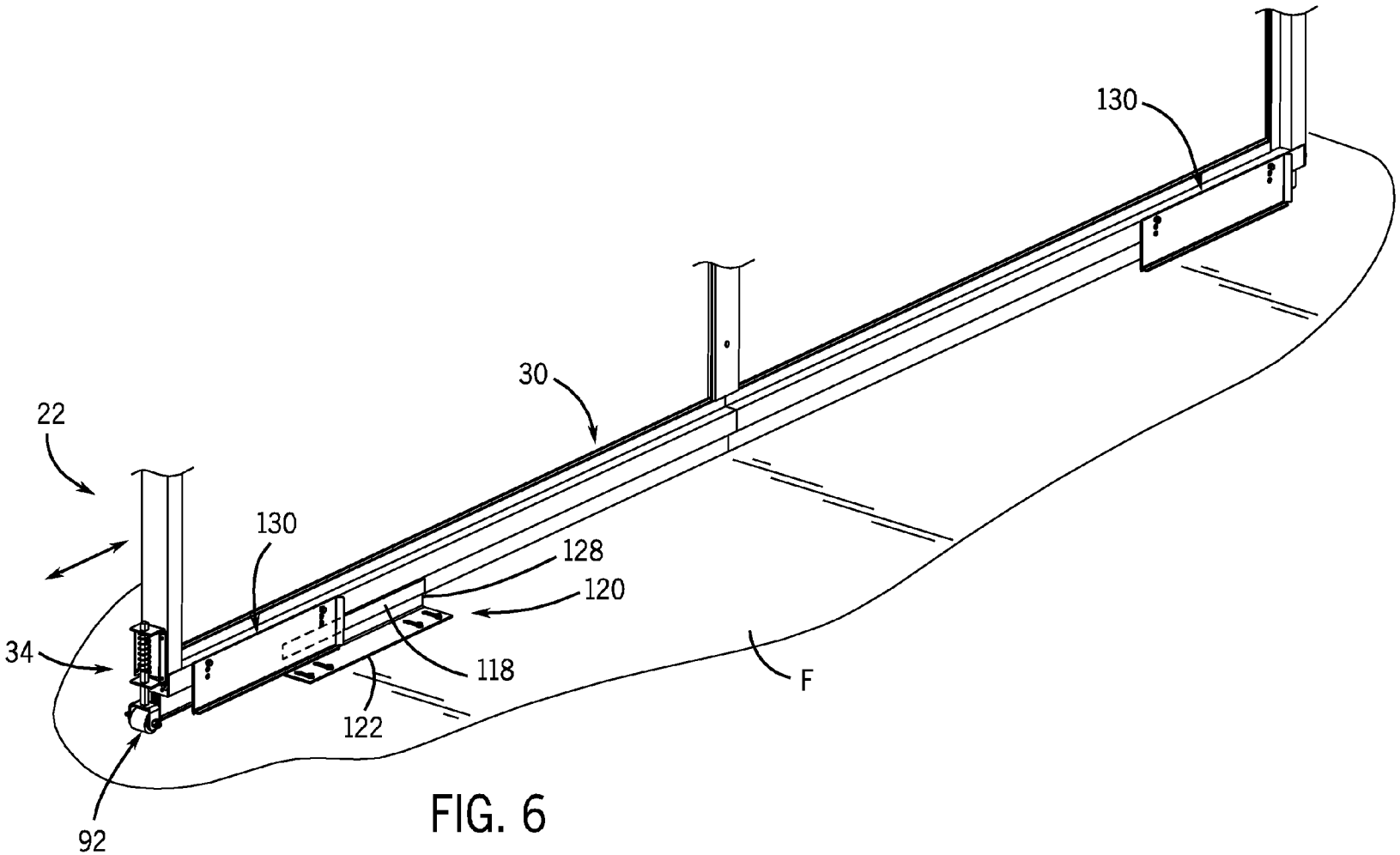
FIG. 6 is a partial isometric view showing a lower area of the storage unit of FIG. 1.
Figure 7:
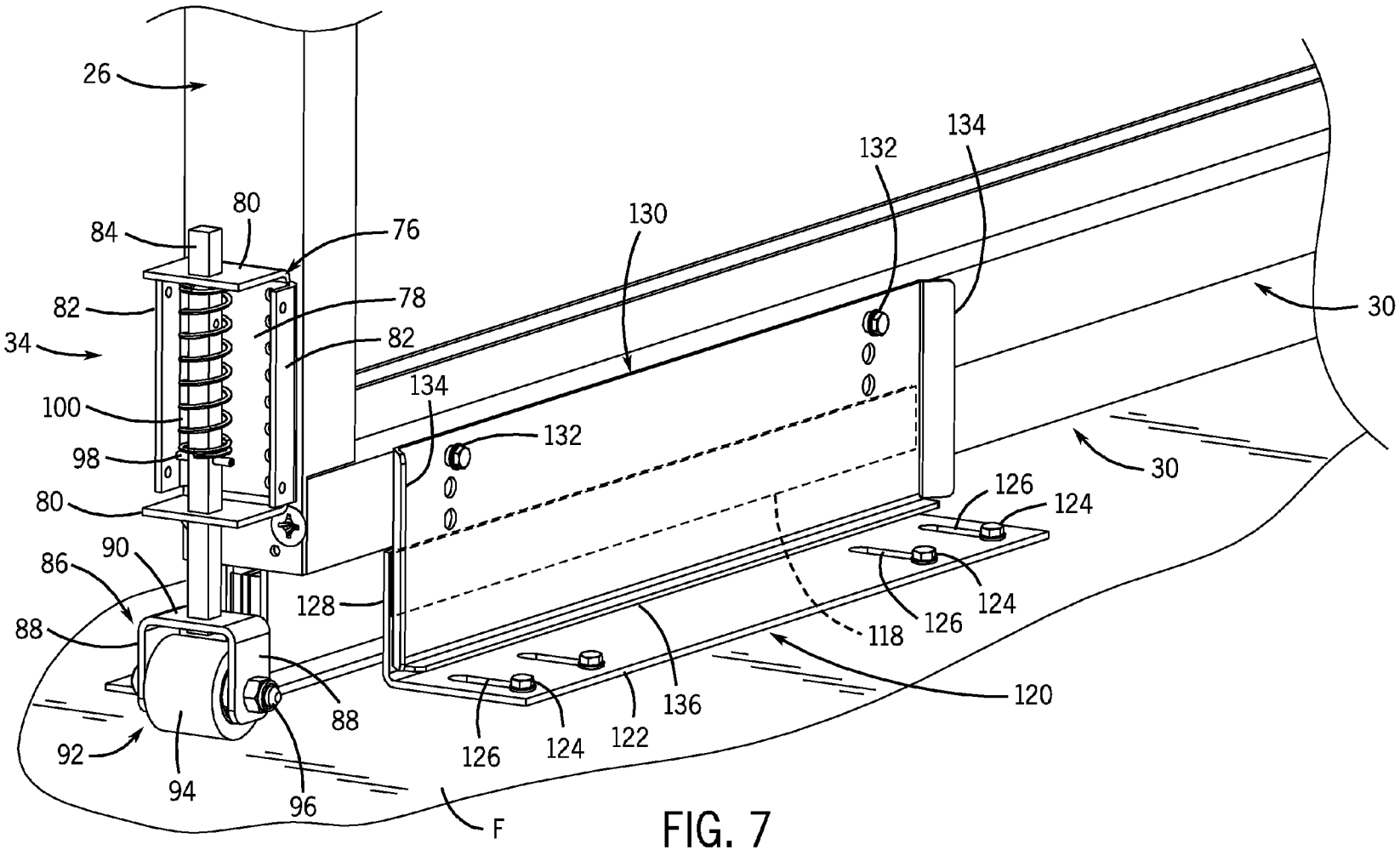
FIG. 7 is an enlarged partial isometric view showing a guide wheel assembly and a brake or decelerator incorporated in the storage unit of FIG. 1.
Figure 9:
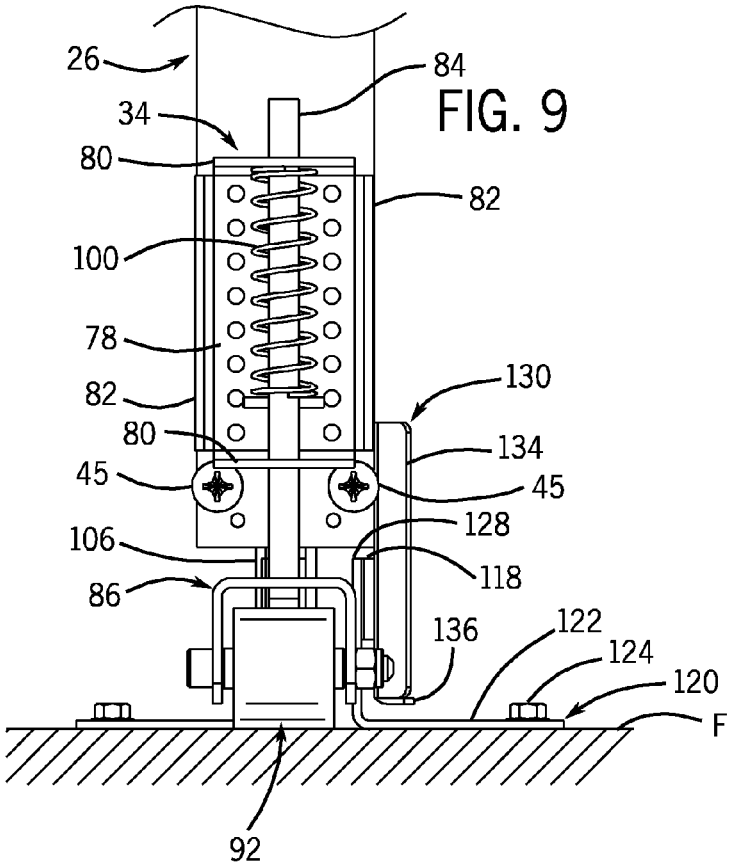
FIG. 9 is an end elevation view showing the guide wheel assembly and the brake or decelerator of FIGS. 7 and 8.
Figure 10:
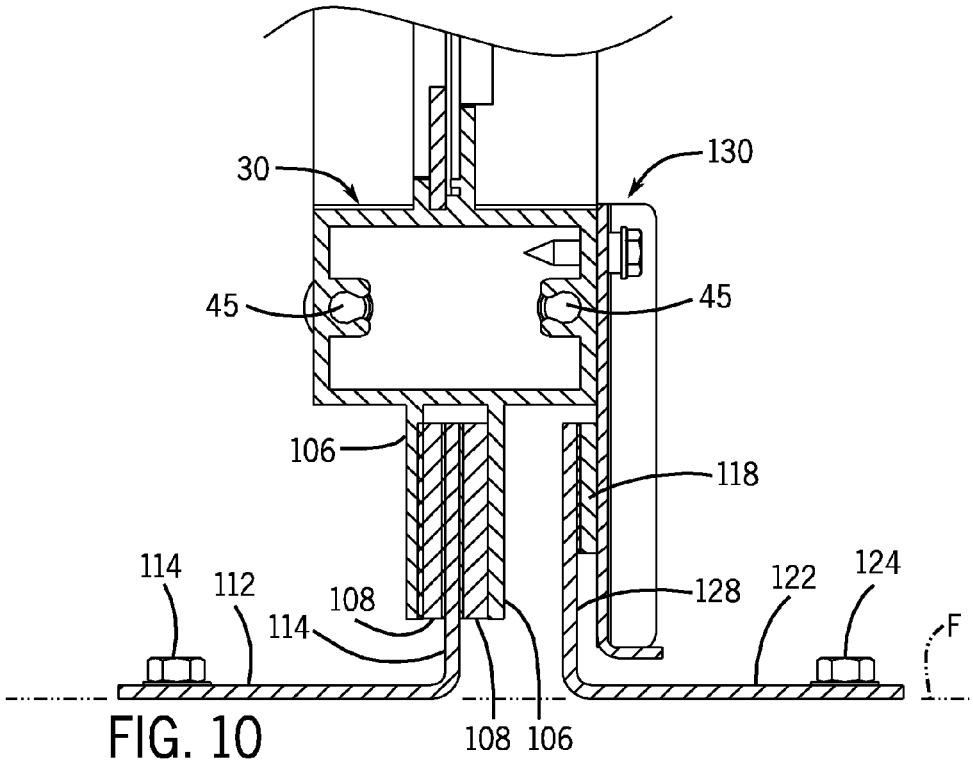
FIG. 10 is a partial section view taken along line 10-10 of FIG. 8.

Referring to FIGS. 6-8, brake or decelerator 36 includes a magnetic strip 118 carried by a magnet mounting member 120. In the illustrated embodiment, magnet mounting member 120 defines a lower horizontal wall 122 that is engaged with floor F via anchors 124 that extend through mounting slots 126 formed in lower horizontal wall 122. Magnet mounting member 120 further includes an upwardly extending vertical magnet mounting wall 128 that extends upwardly from the end of lower horizontal wall 122. Magnet mounting wall 128 is located outwardly of the adjacent flange 106 of lower frame member 30, and the upper end of magnet mounting wall 128 is located below the downwardly facing surface of lower frame member 30. Magnetic strip 118 is secured to magnet mounting wall 128 so as to face outwardly.

A pair of magnetically attractive brake plates 130 are mounted to the outwardly facing side surface of lower frame member 30. Each brake plate 130 is generally planar, and has a length that corresponds to the length of magnet strip 118. Brake plates 130 may be mounted to lower frame member 30 in any satisfactory manner, such as by screws 132 that extend through one of a series of openings in brake plate 130 and into threaded engagement with openings in lower frame member 30. Brake plate 130 may include guide wings 134 at its ends, and a lower lip 136 that extends from the lower edge of brake plate 130. The outer brake plate 130, as shown in FIGS. 7 and 8, overlaps magnetic strip 118 when frame assembly 22 is in the retracted, storage position. The magnetic attraction between magnetic strip 118 and brake plate 130 functions to releasably maintain frame assembly 22 in the retracted position. Upon application of an axial outward force to frame assembly 22, such as via handle 42, the user is able to overcome the magnetic attraction between brake plate 130 and magnetic strip 118, to pull frame assembly 22 outwardly away from the retracted position toward the extended position. In a similar manner, the inner brake plate 130 is in overlapping, aligned relationship with magnetic strip 118 when frame assembly 22 is pulled outwardly to the fully extended position. In this position, the magnetic attraction between magnetic strip 118 and the inner brake plate 130 functions to releasably maintain frame assembly 22 in the extended position. The magnetic attraction between magnetic strip 118 and the inner brake plate 130 functions to slow movement of frame assembly 22 when frame assembly 22 approaches the extended position. Similarly, the magnetic attraction between magnetic strip 118 and the outer brake plate 130 functions to slow movement of frame assembly 22 when frame assembly 22 approaches the retracted position.

In order to adjust the attractive force between magnetic strip 118 and brake plates 130, the lateral spacing between magnetic strip 118 and the facing surface of brake plate 130 can be adjusted by moving magnet mounting member 120 on floor F using slots 126. In this manner, magnetic strip 118 can be moved either toward or away from the facing surface of brake plate 130 to provide the desired retentive force, and then fixed in the desired position by tightening anchors 124 onto lower horizontal wall 122.

Figure 11:
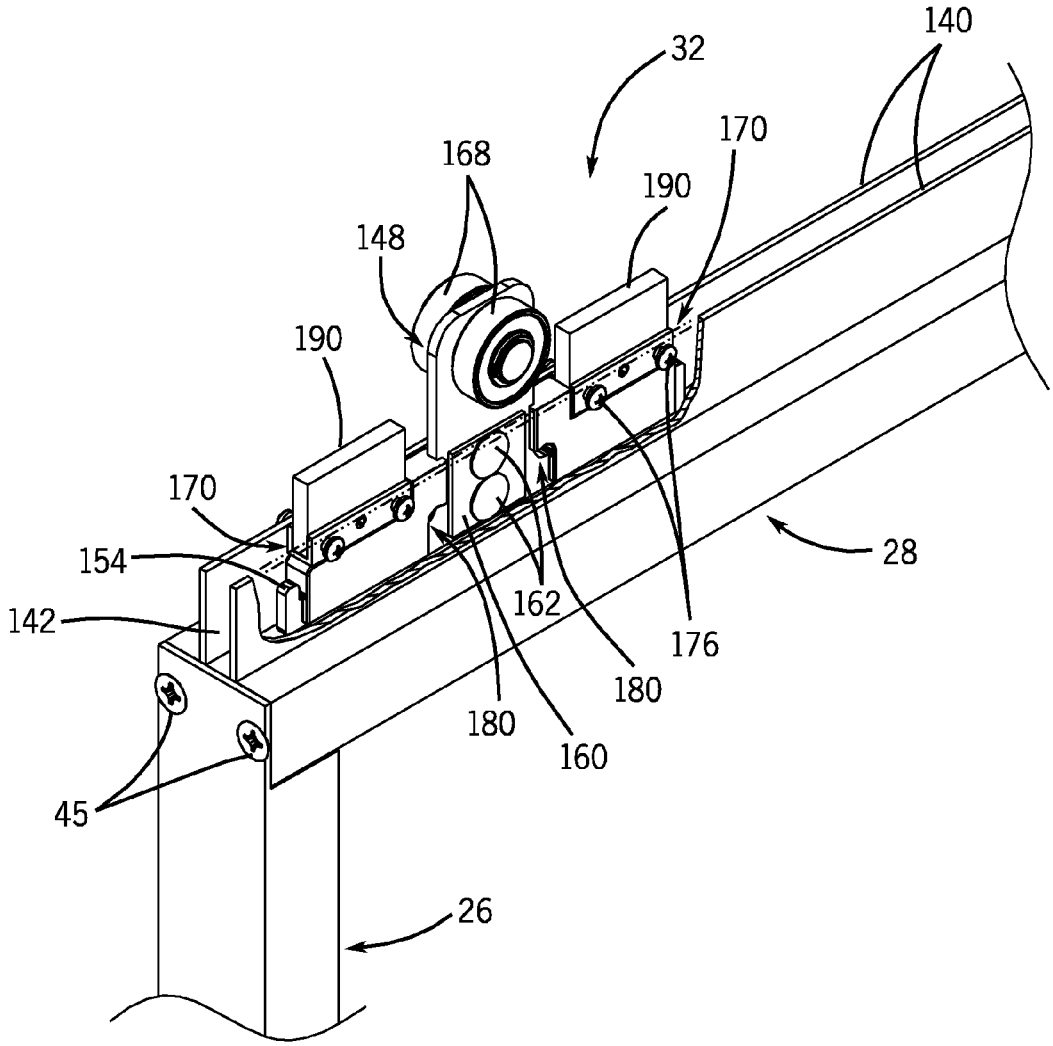
FIG. 11 is a partial isometric view showing a trolley assembly incorporated in an upper area of the frame of the storage unit of FIG. 1.
Figure 12:
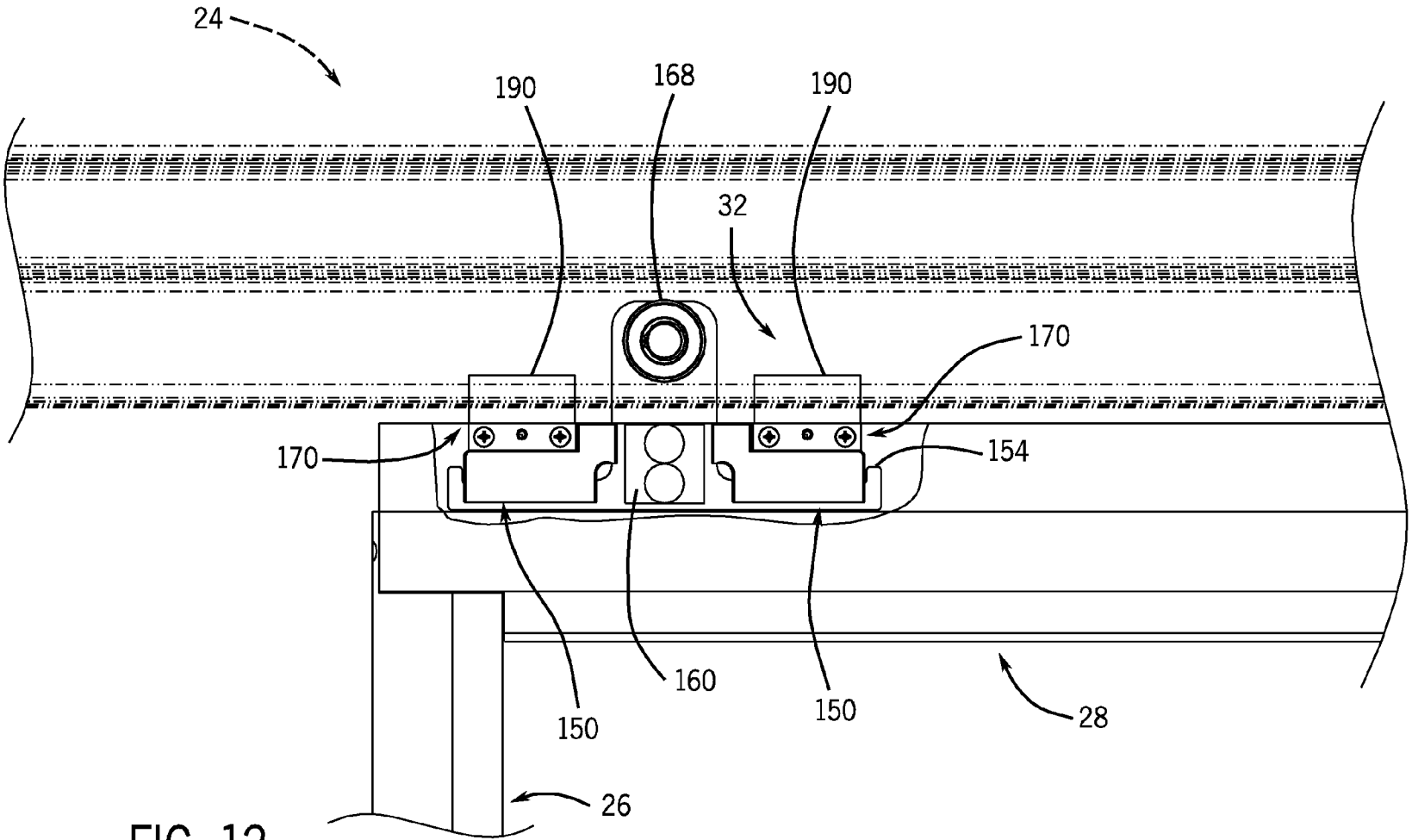
FIG. 12 is a partial side elevation view, with portions broken away, showing the upper area of the storage unit and the trolley assembly of FIG. 11.

Referring to FIGS. 11-13, upper frame member 28 of frame assembly 22 includes a pair of upwardly extending flanges 140, in a manner similar to that of lower frame member 30. Flanges 140 define an axial space or channel 142 therebetween. Each trolley assembly 32 is received within channel 142 for mounting the trolley assembly 32 to frame assembly 22.

Each trolley assembly 32 includes a hanger member 146 that includes a head section 148 and a pair of arms 150 that extend in opposition directions from head section 148. Head section 148 and arms 150 are preferably formed integrally of a metallic material such as steel in a stamping operation, although it is understood that any other satisfactory material or forming method may be employed. Each arm 150 defines a horizontal upper surface 152, and the outer end of each arm 150 terminates in a finger 154 that extends upwardly from the upper surface 152. Head section 148 defines side edges 156 that extend upwardly from the inner end of each arm 150. The lower extent of hanger member 146 is defined by a downwardly facing lower edge 158 that forms a common lower edge of head section 148 and arms 150.

Hanger member 146 has a thickness less than the width of channel 142, so that arms 150 and the lower portion of head section 148 can be positioned within channel 142. Spacers 160 are placed on the oppositely facing surfaces of head section 148 that face the inner surfaces of flanges 140, and glides 162 are mounted to the outwardly facing surfaces of spacers 160. Glides 162 are formed of a low friction material such as a UHMW thermoplastic material, and are sized such that the outer glide surfaces are in close proximity to the inner surfaces of flanges 140. In the illustrated embodiment, glides 162 are secured together through aligned openings in spacers 160 and head section 148, although it is understood that glides 162 may be mounted in any other satisfactory manner. Spacers 160 and glides 162 take up the space between the outwardly facing surfaces of hanger member 146 and the inwardly facing surfaces of flanges 140, to maintain hanger member 146 in a desired vertical orientation relative to frame assembly 22.

The upper area of head section 148 includes an opening through which a transverse roller axle or shaft 166 extends. A pair of rollers 168 are mounted to roller axle or shaft 166, such that rollers 168 are located one on either side of head section 148. As shown in FIG. 3, head section 148 of hanger member 146 is configured to extend through rail guide slot 62, and rollers 168 are received within rail passage 64 such that each roller 168 engages and rests on the crown 64 of one of rail bottom walls 58.

Shaft 166 is formed of a solid steel material, and rollers 168 are in the form of greased and sealed precision track roller bearings mounted to shaft 166. The outer surface of each roller 168 may be in the form of a thick walled, flat outer bearing race that acts as a tire, and efficiently transfers loads to the inner bearing races that are engaged with shaft 166. It is understood that any other satisfactory outer configuration of rollers 168 may be employed, including a concave shape or an arrangement in which a thermoplastic outer tire is applied over a thick walled steel outer race, to reduce noise and vibration and to reduce wear on the inner surface of rail 24. The convex upwardly facing surface formed by crown 64 of each rail bottom wall 58 accommodates slight misalignments between rail 24 and trolley assembly 32.

A pair of frame support mounting members 170 are secured to upper frame member 28 within channel 142. Each frame support mounting member 170 is generally U-shaped in cross section, including a lower wall 172 and a pair of side walls 174 that extend upwardly from lower wall 172. Each frame support mounting member 170 is mounted within channel 142 via fasteners 176 that extend through aligned openings in flanges 140 and through aligned openings in side walls 174. Frame support mounting members 170 are positioned so as to be in vertical alignment with arms 150 of hanger member 146.

A damper member 180 is positioned between each arm 150 and the overlying frame support mounting member 170. Each damper member 180 is generally in the form of a rectangular block formed of a resilient thermoplastic material such as silicon rubber or polyurethane, although it is understood that any other satisfactory material may be employed. Each damper member 170 includes a downwardly facing groove 182, which has a width sufficient to enable the upper area of the underlying arm 150 to be received within the damper member groove 182. Each damper member 170 further includes an inner stabilizer 184 having a vertical groove 186, which is sized so as to engage the lower side area of head section 148 adjacent the intersection between arm upper surface 152 and head section side edge 156. Each damper member 180 has a width slightly less that the width of channel 142, so that the side surfaces of damper member 180 are in close proximity to the inner surfaces of flanges 140. In this manner, damper members 180 function to stabilize hanger member 146 within channel 142. Each damper member 180 fits into engagement with the underlying arm 150 and side area of head section 148 such that the outer end of each damper member 180 is located slightly inwardly of the upstanding finger 154 at the end of the arm 150.

A guide member 190 is mounted to each frame support mounting member 170. Each guide member 190 is in the form of a rectangular block of low friction material, such as a UHMW thermoplastic material, and is sized so as to extend upwardly from the frame support mounting member 170 into rail guide slot 62. Each guide member 190 defines a pair of end passages through which fasteners 176 extend, without engagement with guide member 190. A fastener 192 extends through an aligned opening in the lower area of guide member 190 for engagement with mounting member side walls 174, to maintain guide member 190 in engagement with frame support mounting member 170. Each guide member 190 has a thickness slightly less than the width of guide slot 62, such that the outer surfaces of guide member 190 are in close proximity to the inner surfaces 60 of rail bottom walls 58. Guide members 190 are in alignment with each other, and function to maintain trolley assembly 32 in alignment with rail 24 as trolley assembly 32 is moved along rail 24.

In operation, frame assembly 22 is moved from the retracted position toward the extended position by application of an outward force to frame assembly 22, e.g. by a user applying a manual pull-out force on frame assembly 22 using handle 42. The user-applied outward force overcomes the magnetic attraction between magnetic strip 118 and brake plate 130 that maintains frame assembly 22 in the retracted position, and frame assembly 22 is then moved toward the extended or access position by movement of trolley assemblies 32 on rail 24. As the frame assembly 22 approaches the extended, access position, the inner brake plate 130 approaches the magnetic strip 118, so that the magnetic attraction between brake plate 130 and magnetic strip 118 gradually slows movement of frame assembly 22. Outer bumper 70 engages frame assembly 22 to limit the outward movement of frame assembly 22 to the extended, access position, and the magnetic attraction between brake plate 130 and magnetic strip 118 releasably maintains frame assembly 22 in the extended, access position. When it is desired to return frame assembly 22 to the retracted, storage position, the user applies an inward force on frame assembly 22 to overcome the retention force exerted on brake plate 130 by magnetic strip 118, and pushes frame assembly 22 inwardly along rail 24. As frame assembly 22 approaches the retracted, storage position, the outer brake plate 130 approaches the magnetic strip 118, so that the magnetic attraction between brake plate 130 and magnetic strip 118 gradually slows movement of frame assembly 22. Inner bumper 70 engages frame assembly 22 to limit the inward movement of frame assembly 22 to the retracted, storage position, and the magnetic attraction between brake plate 130 and magnetic strip 118 releasably maintains frame assembly 22 in the retracted, storage position.

As frame assembly 22 is moved on rail 24, guide roller 92 is engaged with and moves on floor F in order to prevent lateral movement of frame assembly 22. The high friction material of guide wheel outer surface 94 functions to provide positive engagement with floor F, and the downward bias applied by spring 110 ensures that guide roller 92 is maintained in engagement with floor F despite any irregularities in the surface of floor F. Guide roller 92 thus functions to guide movement of frame assembly 22 between the extended and retracted positions without the use of a floor-mounted guide track.

The various components of storage unit 20 as shown and described provides, smooth, easy, quiet and vibration-free movement of frame assembly 22 on rail 24 in order to reduce or eliminate movement of the objects supported by frame assembly 22 during movement of frame assembly 22. The configuration of rail 24 minimizes deflection of rail 24 as trolley assemblies 32 move along rail 24 to move frame assembly inwardly and outwardly. The pinned splice joints between adjacent sections of rail 24 ensure proper alignment of the rail sections, to ensure that the trolley assemblies 32 do not experience bumps or obstructions during movement from one rail section to the next. The crowned interface between the rollers and the rail surfaces ensures smooth and easy trolley assembly movement with a minimal amount of friction between the trolley rollers and rail surfaces. The components of trolley assembly 32 are assembled to the frame assembly 22 so that there is no metal-to-metal contact between each trolley assembly 32 and the frame assembly 22, which provides smooth and quiet operation. The spring characteristics of the damper members 180 promote smooth navigation of the trolley assemblies to rail 24, since the trolley assemblies 32 are not rigidly attached to the structure of frame assembly 22.

While the invention has been shown and described with respect to a specific embodiment, it is understood that various alternatives and modifications are contemplated as being within the scope of the present invention. For example, and without limitation, it is understood that the various features as shown and described may be used individually or in various subcombinations. It is particularly advantageous, however, to utilize the various features in combination as shown and described, to provide a storage unit that can easily be moved between extended and retracted positions in a smooth, vibration-free manner, to avoid jarring items or objects stored on the frame assembly. As to the individual features, it is understood that the particular configuration of the various walls and surfaces of rail 24 may vary from that shown and described. The manner in which the components of frame assembly 22 are interconnected together may also vary, e.g. the components may be connected in any other satisfactory manner such as by welding. Guide wheel assembly 34 may be mounted in any satisfactory location on the frame assembly, and the specific mounting and biasing arrangement of the guide wheel assembly may take any other satisfactory form. The magnetic strip and brake plate members of brake or decelerator 36 may be mounted in any other satisfactory manner to the floor and the lower end of the frame assembly, and the arrangement of the magnetic strip and brake plate components may be reversed from that shown. The specific arrangement of trolley assembly 32 may also vary, in that the frame member may be suspended in any satisfactory manner from the arms of the hanger member. The damper member may take any other satisfactory form, and may be positioned between the hanger member arm and the frame support mounting member in any satisfactory manner. Hanger member arms 150 may be engaged with any satisfactory structure of the frame member other than channel 142. It is also understood that the various features as shown and described may be used with a storage arrangement other than a frame with vertical mounting surfaces, e.g. a storage cabinet with drawers or the like or a shelf-type storage arrangement.

Various alternatives and embodiments are contemplated as being within the scope of the following claims particularly pointing out and distinctly claiming the subject matter regarded as the invention.

We claim:

1. A suspension-type storage unit, comprising:

an overhead rail defining a downwardly open guide slot and a pair of support surfaces located one on each side of the guide slot;

a frame; and a pair of trolleys interposed between the rail and the frame for enabling movement of the frame relative to the rail along the guide slot, wherein each trolley includes:

a head section that extends through the guide slot;

a wheel arrangement mounted to the head section, wherein the wheel arrangement includes a pair of wheels between which the head section is located, and wherein each wheel is engaged with one of the overhead rail support surfaces; and a pair of arms that extend from the head section, wherein the frame is engaged with the pair of arms such that the frame is supported from the pair of arms in a suspension-type manner wherein the frame includes an upwardly facing channel, wherein the pair of arms are disposed in the channel, and wherein the frame is supported from the arms via a frame support member mounted within the channel over each of the arms, and wherein each frame support member includes a mounting member secured to the frame within the channel, and a damper member between each arm and one of the mounting members.

2. The storage unit of claim 1, further comprising a guide member mounted to each mounting member, wherein each guide member extends upwardly from the mounting member into the downwardly open guide slot of the overhead rail to maintain the trolley in alignment with the rail during movement of the trolley along the rail.

3. The storage unit of claim 2, wherein the guide members comprise aligned blocks of low friction material.

4. The storage unit of claim 3, wherein each mounting member includes an upwardly facing groove, wherein each guide member defines a lower end that is received within one of the grooves.

5. The storage unit of claim 1, wherein the channel is defined between a pair of upwardly extending flanges, and wherein the frame support member is secured within the frame channel via a pair of spaced fasteners that extend through the flanges and through the frame support member.

6. The storage unit of claim 1, wherein the pair of arms are formed of a metallic material, and wherein each frame support member includes a mounting member secured to the frame within the channel, wherein the mounting member is formed of a metallic material, and a damper member between each arm and one of the mounting members, wherein the damper member is formed of a non-metallic resilient material.

7. The storage unit of claim 1, wherein the wheel arrangement comprises a shaft that extends through an opening in the head section, and wherein the each wheel is mounted to an area of the shaft that extends outwardly from one side of the head section.

8. The storage unit of claim 1, wherein each arm is engaged with the frame via a frame support member that overlies the arm, and wherein the frame support members are mounted to the frame on opposite sides of the head section so that each arm is engaged with the frame in a cantilever fashion.

9. A method of securing a storage member of a storage unit in a suspension-type manner to a trolley, comprising the steps of:

providing a trolley having a wheeled upper section and a pair of arms located below the upper section and extending in opposite directions;

engaging a mounting member with the storage unit over each arm; and positioning a damping member between each arm and the overlying mounting member, wherein the damper member is formed of a resilient material to cushion the connection of the storage unit to the trolley.

10. The method of claim 9, wherein the storage unit includes an upwardly facing channel, and wherein the arms and the mounting members are located within the channel.

11. The method of claim 9, wherein the trolley is adapted for suspension from a rail having a downwardly open guide slot, and further comprising the steps of securing a guide member to the mounting member, and positioning the guide members within the downwardly facing guide slot.

12. A suspension-type storage unit, comprising:

an overhead rail spaced above an upwardly facing surface;

a frame defining an upper area and a lower area;

a movable suspension-type connection between the rail and the upper area of the frame for providing movement of the frame along the rail; and a guide wheel carried by the lower area of the frame, wherein the frame is configured and arranged such that the guide wheel is engaged with the upwardly facing surface to guide movement of the frame relative to the upwardly facing surface as the frame is moved along the rail, wherein a biasing arrangement is interconnected with the guide wheel for biasing the guide wheel into engagement with the upwardly facing surface, and wherein the guide wheel is mounted to a lower end of a shaft, wherein the shaft is mounted in aligned openings in a mounting bracket secured to the frame, and wherein the biasing arrangement comprises a spring that acts on the shaft and on the mounting bracket to bias the shaft, and thereby the guide wheel, downwardly into engagement with the upwardly facing surface.

13. A method of guiding movement of a suspension-type storage unit relative to an upwardly facing surface, wherein the storage unit is movably mounted on an overhead rail spaced above the upwardly facing surface and carries a guide wheel mounted to a lower end of a shaft mounted in a mounting bracket secured to the storage unit and surrounded by a spring acting on the shaft and the mounting bracket, comprising the act of engaging the guide wheel carried by the storage unit with the upwardly facing surface, wherein the guide wheel functions to guide movement of the storage unit relative to the upwardly facing surface as the storage unit is moved along the rail.

14. The method of claim 13, further comprising the act of biasing the guide wheel downwardly into engagement with the upwardly facing surface.

15. A suspension-type storage unit, comprising:

an overhead rail spaced above an upwardly facing surface;

a frame defining an upper area and a lower area;

a movable suspension-type connection between the rail and the upper area of the frame for providing movement of the frame along the rail for providing movement of the frame between first and second positions relative to the upwardly facing surface; and a deceleration arrangement including a magnetic member and a magnetically attractive member interposed between the lower area of the frame and the upwardly facing surface to slow movement of the frame as the frame approaches at least one of the first and second positions relative to the upwardly facing surface, wherein spacing between the magnetic member and the magnetically attractive member is adjusted by a mounting member having a vertical wall for mounting one of the magnetic member and the magnetically attractive member, and a lower horizontal wall having a plurality of slots formed therein for receiving fasteners connecting the horizontal wall to the upwardly facing surface.

16. The storage unit of claim 15, wherein the first and second positions are end-of-travel positions.

17. The storage unit of claim 15, wherein magnetic forces between the magnetic member and the magnetically attractive member cooperate to slow movement of the frame as the frame approaches the first and second positions.

18. The storage unit of claim 17, wherein one of the magnetic member and the magnetically attractive member is normally stationarily mounted to the upwardly facing surface, and wherein the other of the magnetic member and the magnetically attractive member is mounted to the frame for movement along with the frame.

19. The storage unit of claim 15, wherein the lower area of the frame includes a guide structure that receives a guide member attached to the upwardly facing surface for tracking the lower area of the frame as the frame is moved along the rail.

20. The storage unit of claim 19, wherein the guide structure and the guide member are spaced inwardly from the mounting member.

* * * * *